United States Patent [19]

Sarto

[11] 4,127,627

[45] Nov. 28, 1978

[54] COUNTERBALANCED THROTTLE FOR I.C. ENGINE

[75] Inventor: Jorma O. Sarto, Orchard Lake, Mich.

[73] Assignee: Chrysler Corporation, Highland Park, Mich.

[21] Appl. No.: 830,260

[22] Filed: Sep. 2, 1977

Related U.S. Application Data

[62] Division of Ser. No. 807,099, Jun. 16, 1977.

[51] Int. Cl.[2] ..... F02M 9/14

[52] U.S. Cl. ..... 261/41 B; 138/45; 138/46; 251/212; 251/282; 261/41 D; 261/44 D; 261/48; 261/DIG. 63; 261/DIG. 78

[58] Field of Search ..... 251/212, 282; 261/DIG. 63, DIG. 56, DIG. 78, 44 D, 48, 41 B, 41 D, 62, 53; 138/45, 46

[56] References Cited

U.S. PATENT DOCUMENTS

| | | | |
|---|---|---|---|
| 882,170 | 3/1908 | Schmidt | 251/282 |
| 1,134,365 | 4/1915 | Barnes | 261/DIG. 78 |
| 1,370,944 | 3/1921 | Bracke | 261/DIG. 63 |
| 1,733,668 | 10/1929 | Leibing | 261/DIG. 63 |
| 1,791,623 | 2/1931 | Hutchinson | 261/62 |
| 1,818,928 | 8/1931 | Kreher | 261/DIG. 63 |
| 1,983,255 | 12/1934 | Wahlmark | 261/DIG. 78 |
| 2,633,868 | 4/1953 | Berhoudar | 251/282 |
| 3,953,548 | 4/1976 | Knapp | 261/DIG. 78 |
| 4,034,028 | 7/1977 | Ma | 261/44 D |

FOREIGN PATENT DOCUMENTS

| | | | |
|---|---|---|---|
| 101,247 | 4/1921 | Switzerland | 261/DIG. 63 |
| 337,505 | 11/1930 | United Kingdom | 261/44 |
| 1,278,291 | 6/1972 | United Kingdom | 261/23 A |

*Primary Examiner*—Tim R. Miles
*Attorney, Agent, or Firm*—Baldwin & Newtson

[57] ABSTRACT

The throttle for the air inlet passage of an automobile internal combustion engine comprises a variable restriction diffuser within the passage and designed for sonic velocity gas flow through its region of maximum restriction throughout substantially the entire operating range of the engine. The diffuser comprises an orifice member and a closure member movable axially in opposite direction within the passage to vary the aforesaid maximum restriction and operatively coupled with the throttle control linkage for such movement, whereby the force required to move either diffuser member against the force of the fuel and air inlet flow within the passage is counterbalanced by an oppositely directed force exerted by said flow on the other diffuser member.

18 Claims, 4 Drawing Figures

FIG. 1.
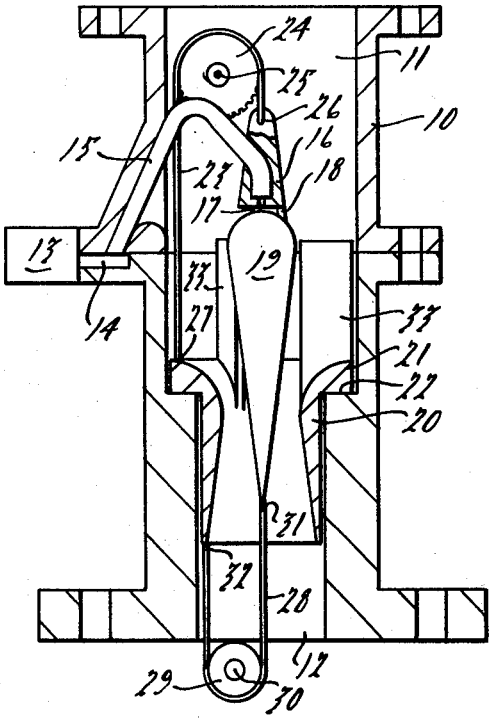
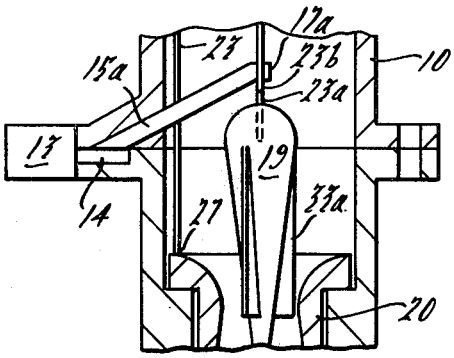
FIG. 2.
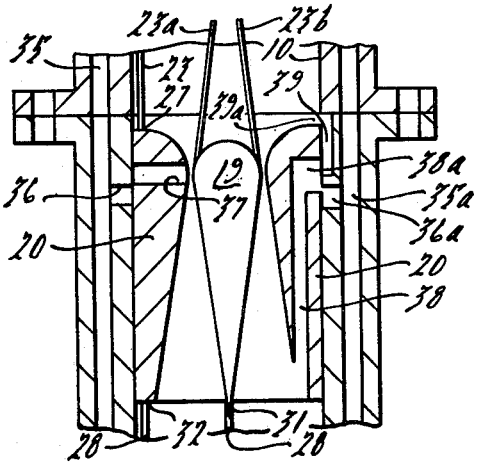
FIG. 3.
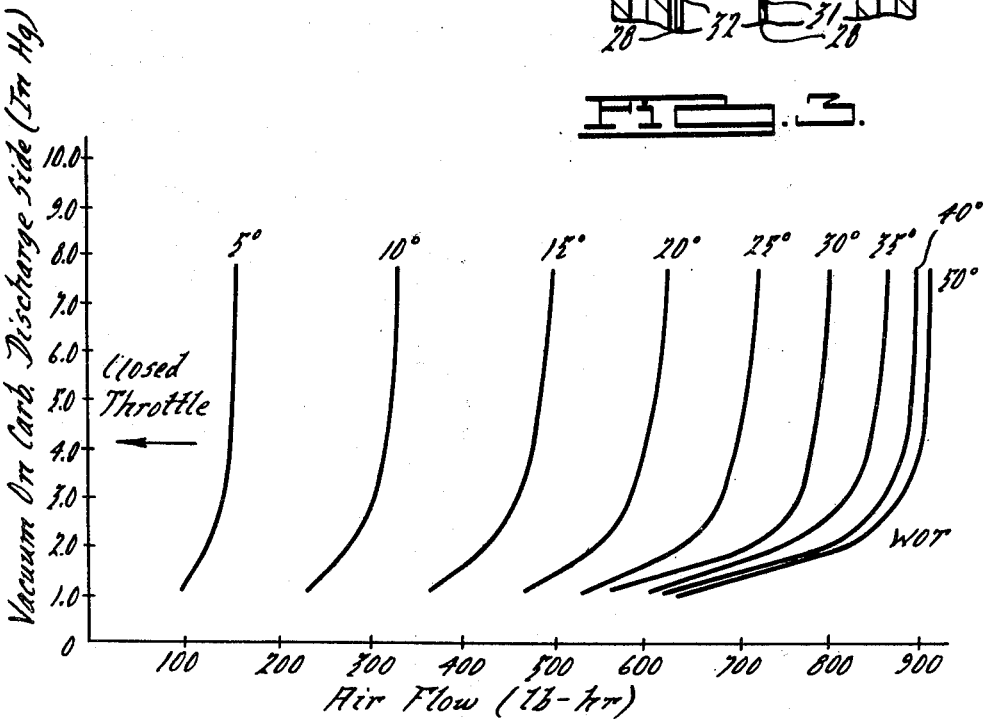
FIG. 4.

COUNTERBALANCED THROTTLE FOR I.C. ENGINE

BACKGROUND AND OBJECTS OF THE INVENTION

This application is a division of copending application, Ser. No. 807,099, filed 6/16/77, and relates to throttle means for controlling the flow of liquid fuel for an internal combustion engine and for atomizing or breaking-up and mixing the fuel with air to effect a homogeneous dispersion of fine fuel droplets in a gaseous fuel-air mixture to facilitate complete evaporation of the fuel prior to combustion in the engine.

A primary object is to provide essentially symmetrical throttle means comprising a pair of throttle members such as an annulus or orifice member and a coaxial closure member relatively movable axially with respect to each other and shaped to vary the effective opening of the orifice member by the relative movement.

Another object is to provide such throttle means shaped to comprise a variable restriction diffuser for effecting gas flow at sonic velocity therethrough at its region of maximum restriction throughout a comparatively wide range of positions of the relatively movable throttle members corresponding to all operating conditions of the engine from idle to near wide open throttle.

Other objects of this invention will appear in the following description and appended claims, reference being had to the accompanying drawings forming a part of this specification wherein like reference characters designate corresponding parts in the several views.

FIG. 1 is a fragmentary schematic sectional view through the axis of a fuel-air induction conduit for an automobile internal combustion engine, showing a throttle embodying the present invention at the wide open position.

FIGS. 2 and 3 are views similar to FIG. 1, showing modifications.

FIG. 4 is a diagram showing the relationship between manifold vacuum and air flow at various positions of throttle opening.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Referring to the drawings, an embodiment of the present invention is illustrated in FIG. 1 comprising a fuel-air induction passage or conduit 10 having an upstream air inlet 11 and a downstream fuel-air discharge opening 12 which communicates with the engine. Fuel may be supplied to the passage 10 by an conventional fuel metering system, as for example by fuel injection or carburetor induction. FIG. 1 shows a fuel injection system wherein a fuel metering and supply system 13 discharges liquid fuel at 14 in communication with a flexible conduit 15. The latter extends through the side wall of the passage 10 and has a free end secured within a movable retainer or carrier 16 for discharging axially downwardly through a restricted fuel injection nozzle 17 of the carrier 16. The latter is connected by a small bracket 18 with the upper end of a conical throttle valve member 19 having a rounded streamlined upper end immediately underlying the nozzle 17 to deflect fuel therefrom generally radially and uniformly within the conduit 10.

The valve member 19 extends coaxially within the conduit 10 and cooperates with an orifice or annular throttle member 20 to vary the central opening of the latter and thereby to control the flow of the fuel-air mixture therethrough. The upstream end of the member 20 enlarges radially at 21 to provide a shoulder adapted to seat upon a mating radial shoulder 22 integral with the side wall of the conduit 10. The outer circumference of the member 20 and of the enlargement 21 are cylindrical and closely interfit with the adjacent cylindrical surface of the conduit 10 to effect a high resistance annular flow passage between the member 20 and conduit 10, so that substantially all of the fuel-air flow within the conduit 10 passes through the central orifice of the member 20.

Relative axial movement between the members 19 and 20 is effected by a flexible cable or sprocket chain 23 extending within the conduit 10 and looping over a pulley 24 rotatably mounted on a shaft 25 that extends transversely within the conduit 10 at a fixed location somewhat above the maximum desired upstream position of member 19 at the wide open throttle position. One end of the cable 23 is secured coaxially within conduit 10 at 26 to an upper portion of the retainer 16. The opposite end of the cable 23 is secured at 27 to an upper portion of the enlargement 21. The shaft 25 is operatively connected with the customary throttle control level for the engine so as to rotate pulley 24 counterclockwise in a throttle opening movement or clockwise in a throttle closing movement.

The members 19 and 20 are shaped to comprise a variable restriction diffuser capable of conducting gas flow therebetween at the region of maximum restriction at sonic velocity throughout essentially the entire operating range of the engine. In a preferred construction, the member 19 converges conically in the downstream direction at an angle approximating $3\frac{1}{2}°$ with respect to the axis of the conduit 10. From a region of maximum restriction, the orifice of the member 20 enlarges conically in the downstream direction at approximately the same angle with respect to the axis of conduit 10. Upstream of the region of maximum restriction, the orifice of the member 20 enlarges symmetrically with respect to the axis of the conduit 10 to effect the desired diffuser action in accordance with known principles.

Specifically, the diffuser 19,20 is designed for the engine and induction conduit 10 so as to effect substantially sonic velocity therethrough at its region of maximum restriction when the members 19,20 are at the wide open position, FIG. 1, with the enlargement 21 resting on the shoulder 22. It is to be noted that the region of maximum restriction for the diffuser 19,20 will always be the region of maximum restriction for the orifice member 20, although the maximum restriction will vary depending upon the relative axial position of the member 19.

As illustrated in FIG. 4, with most two barrel and single barrel carburetors, if substantially sonic velocity is achieved at wide open throttle, it will be achieved even more readily when the maximum diffuser restriction is increased. Most single and two barrel fuel-air inlet systems may be designed to operate at wide open throttle at approximately 3 inches of mercury vacuum, i.e. at a pressure equivalent to 3 inches of mercury below atmospheric pressure, downstream of the throttle of diffuser 19,20, i.e. at the discharge orifice 12. FIG. 4 shows that as the wide open throttle vacuum increases above approximately 3 inches of mercury downstream of the throttle 19,20, the rate of change of the inlet fuel-air flow with increasing vacuum becomes almost zero, indicating that sonic velocity has been achieved. Likewise as the throttle closes to decrease the total fuel-air flow, the approximate sonic velocity is more readily obtained at even higher pressures, i.e. at lesser vacuum pressures. Also as the throttle closes toward the idle condition, the downstream vacuum at the manifold region 12 actually increases, so that sonic velocity through the restricted portion of the diffuser is even more readily obtained at less than 3 inches mercury vacuum.

Although the air flow urges both diffuser member 19 and 20 downwardly to maintain the cable 23 taut, stabilization of the member 19 and positive throttle opening and closing movements of these members in opposite directions may be assured by means of a second lower cable 28 that passes around a downstream puulley 29 journalled on a shaft 30 at a fixed location within the conduit 10 downstream of the diffuser 19,20. Opposite ends 31 and 32 of the cable 28 are secured to lower portions of the members 19 and 20 respectively so as to cooperate with the upper cable 23 to provide a closed loop, whereby as one of the members 19,20 moves in one direction, the other will necessarily move in the opposite direction. The pulleys 24 and 29 cooperate as guides for the cables 23 and 28 to eliminate lost motion in the overall loop which comprises a throttle control system. Also where desired, several guide vanes 33 integral with the enlargement 21 and extending upwardly therefrom and radially into the conduit 10 may be provided to maintain the member 19 in coaxial alignment as it moves upwardly toward the wide open position.

In accordance with the foregoing, liquid fuel or a fuel-air mixture discharging from nozzle 17 strikes the rounded upper end of member 19 and is deflected radially into the air stream entering via 11. The liquid fuel is further dispersed during its downward flow within conduit 10. At the region of sonic velocity in the restricted portion of the diffuser 19,20, the remaining liquid fuel droplets are fragmentated as they flow into the downstream enlarging portion of the diffuser 19,20 and thence from the outlet 12 to the engine. It is also to be noted that the force exerted by cable 23 required to raise the member 19 in a throttle opening movement against the downward flow of the fuel-air mixture is counterbalanced by a substantially equal force exerted on the member 20. Similar counterbalancing of the throttle actuating force occurs during throttle closing. In this regard, the effective cross sectional areas of the members 19 and 20 exposed to the fuel-air flow are substantially equal. Leakage below the enlargement 21 at the wide-open position may counterbalance the pressure at its topside.

FIG. 2 illustrates a modification of the present invention wherein the structure and operation are substantially the same as described above and corresponding parts are numbered as in FIG. 1. The principal difference in FIG. 2 is that instead of the flexible fuel conduit 15, a rigid conduit **15*a* communicates between the fuel inlet duct 14 and a fixed nozzle 17*a* that discharges axially in the downstream direction directly above the throttle member 19. The cable 23 bifurcates into portions 23*a* and 23*b* which extend to attachments with the upper end of member 19 at diametrically opposite locations as illustrated in FIG. 3 in order to avoid interference with the fixed conduit 15*a*. Also in FIG. 2, guide vanes 33*a* integral with the member 19 replace the guides 33 but serve the same purpose of maintaining the member 19 in coaxial alignment within the conduit 10**.

The devices of FIGS. 1 and 2 are primarily adapted for a single barrel induction conduit employed with fuel injection. The modification shown in FIG. 3 is substantially the same in operation and construction as described above in regard to FIGS. 1 and 2, but is adapted for use with a conventional carburetor where the primary fuel supply is induced into the conduit 10 by aspirator action at the throat of a venturi, as illustrated in FIGS. 4 and 5 of said copending application by way of example. During idle operation when insufficient air flows through the fuel inducing venturi to supply fuel for idle, such fuel is supplied via a conventional idle mixture port downstream of the throttle 19,20, also as illustrated in said copending application. Preferably a transfer fuel supply port is provided to supplement the conventional idle system and supply increasing amounts of fuel to operate the engine when the throttle opens from the idle position to an intermediate position where the air flow through the fuel inducing venturi is insufficient to induce an adequate flow of operating fuel.

In FIG. 3, such transfer ports are provided in the throttle orifice member 20, which differs from the orifice member 20 of FIGS. 1 and 2 by the omission of the enlargement 21. Accordingly the annular or radial seat 22 shown in FIGS. 1 and 2 is not required. The passage 10 in FIG. 3 is cylindrical throughout the movement range of the member 20. The primary fuel supply communicates with an idle fuel and air supply conduit 35 that extends axially within the wall of passage 10 to the aforesaid idle mixture port, not shown. An axially extending transfer slot 36 opens radially into the conduit 10 from the conduit 35 at the region of the orifice member 20. A transfer port or duct 37 extends radially through the member 20 at or slightly downstream of the latter's region of maximum restriction, so as to communicate with the slot 36 except when the member 20 moves downwardly below a predetermined intermediate position of throttle opening.

At the idle position shown in FIG. 3, a port 36 is substantially closed by member 20, although if desired a small fuel flow from 36 into 37 may be permitted by suitably dimensioning the ports 36 and 37. Also the radial port 37 is substantially closed by the member 19 and very little air flows through the inducer 19,20. Accordingly, the major idle fuel is supplied downstream of the throttle at the aforesaid idle mixture port while up to 10% of the idle fuel may be supplied via 37. As the throttle members 19,20 progressively move in a throttle opening direction from the idle position, port 37 progressively opens into passage 10 upon relative upward movement of member 19. Port 37 also progressively opens to port 36 as the member 20 moves downward. Simultaneously the restriction of the inducer 19,20 progressively decreases to enable increasing air flow therethrough, thereby to increase the fuel flow through conduit 37 progressively as required for increased engine operation until such time as the aforesaid primary fuel inducing venturi becomes effective to supply adequate fuel. As the venturi induced primary fuel flow begins to increase, the port 37 closes by moving below the lower end of slot 36, thereby to shut off the fuel flow via the transfer port 37.

Another type of transfer porting is illustrated in the right half of member 20 diametrically opposite the ports 36,37 and comprises an axial idle fuel-air conduit 35*a* comparable to the conduit 35, which communicates with the interior of conduit 10 via a radial transfer slot 36*a* at a location adjacent and downstream of the maximum restriction for the diffuser 19,20 when these members are at the idle position shown. An air bypass duct 38 extends axially within the right half of member 20, opens radially at an upper transfer port or duct 38*a* toward the wall of conduit 10, and opens axially downwardly into the latter conduit. Above the transfer slot 36*a*, an air bypass slot 39 is formed in the inner wall of the conduit 10 for conducting gas from above the member 20 into the port 38*a* when the member 20 moves downwardly from the idle position. Also at the idle position the outer cylindrical wall of the member 20 substantially (or completely if desired) closes the transfer slot 36*a*, so that the idle fuel flow via 36*a* will usually not amount to more than 10% of the total. If desired, the slot 39 may open slightly at 39*a* above the member 20 at the idle position, thereby to reduce the vacuum in duct 38 and the consequent leakage of fuel thereinto from slot 36*a*. Such limited flow of bypass air via the slot 39 and thence via 38*a* and 38 to a downstream location of the induction conduit 10 may be nominal and may be eliminated entirely by dimensioning the slot 39 and member 20 so as to reduce or eliminate the opening 39*a* at the idle position.

As the throttle members 19 and 20 progressively open from the idle position shown, the port 39*a* progressively opens to increase the bypass air flow through conduit 38. Simultaneously the downward movement of member 20 progressively opens transfer slot 36*a* into port 38*a* to effect a progressively increasing flow of transfer fuel by aspirator action down 38 into conduit 10. As the throttle diffuser members 19 and 20 continue to open, communication between port 38*a* and slot 39 is progressively closed by the upper cylindrical edge of member 20 to decrease the bypass air flow. Simultaneously slot 36*a* continues to open to discharge the maximum transfer fuel into duct 38. Thereafter upon continued throttle opening, the upper end of member 20 gradually closes slot 36*a* and eventually blocks the transfer fuel flow completely at a predetermined position of throttle opening whereat the aforesaid primary venturi induced fuel flow is effective to operate the engine. However, complete blockage of the transfer fuel flow via either 36 or 36*a* is not essential because the idle fuel flow is restricted at the outset. Thus a nominal leakage of fuel from the transfer port system during cruise conditions will not be objectionable.

Although the two types of transfer ports could be employed with a single carburetor, two are shown primarily for the sake of illustration. Ordinarily a single transfer system will be adequate to supply the required transfer fuel as the throttle opens from the idle position.

I claim:

1. In a fuel supply means for an automobile engine, an inlet induction passage, a fuel supply port opening into said passage, said passage having an upstream inlet for receiving air and a downstream outlet for discharging a fuel-air mixture, throttle means in said passage downstream of said fuel supply port for controlling the axial flow of said mixture in said passage comprising a pair of throttle members movable axially of said passage and dimensioned to effect a variable restriction for said passage upon simultaneous movement of said members in axially opposite directions, said variable restriction comprising a variable geometry flow diffuser for conducting said flow therethrough at nearly sonic velocity at its region of minimum cross sectional area throughout the major operating range of said engine, and means for essentially balancing the force required to move either member in one axial direction against said flow by simultaneously moving the other member axially with said flow throughout the movement of said members.

2. In the combination according to claim 1, means for supplying fuel to said passage downstream of said fuel supply port comprising a transfer port in one of said members communicating with said passage, means on the other of said members for restricting said transfer port when said members are at a predetermined position to effect maximum restriction for said passage and for progressively increasing the communication between said transfer port and passage upon said simultaneous movement from said predetermined position.

3. In the combination according to claim 2, said means for supplying fuel to said passage downstream of said fuel supply port also comprising a transfer slot opening into said passage through the sidewall thereof, means on said one member for effecting a restricted communication between said transfer slot and transfer port when said members are at said predetermined position, for progressively increasing the communication between said transfer slot and transfer port upon said simultaneous movement of said members for a predetermined limited extent from said predetermined position, and for thereafter decreasing the communication between said transfer slot and transfer port upon continuation of said simultaneous movement beyond said limited extent.

4. In the combination according to claim 1, a fuel transfer slot communicating with said passage for supplying fuel thereto through the sidewall thereof downstream of said fuel supply port, a bypass conduit in one of said throttle members having a downstream port opening into said passage downstream of said transfer slot, said bypass conduit also having an upstream port cooperating with said transfer slot to receive increasing amounts of fuel therefrom upon limited simultaneous movement of said members from a location of maximum restriction for said passage.

5. In the combination according to claim 4, means on said one throttle member for progressively closing said transfer slot upon continued simultaneous movement of said members from said location after said limited simultaneous movement.

6. In the combination according to claim 4, means provided by said induction passage and one throttle member for effecting communication between said passage and upstream port when said members are at said location and for progressively closing said communication upon said limited simultaneous movement.

7. In the combination according to claim 6, said means provided by said one throttle member also cooperating with said transfer slot to close the latter upon continued simultaneous movement of said members from said location after said limited simultaneous movement.

8. In the combination according to claim 1, said members being dimensioned to effect a maximum restriction for said passage when at a predetermined location with respect to each other and decrease said restriction progressively upon said simultaneous movement from said predetermined location.

9. In the combination according to claim 8, said means for effecting said simultaneous movement comprising throttle control means moveable between open and closed positions, means connecting said throttle control means and said members for moving one of the latter in one axial direction from said predetermined location and for moving the other from said predetermined location in the axial direction opposite said one direction upon movement of said throttle control means from its closed position.

10. In the combination according to claim 8, said means for effecting said simultaneous movement comprising first and second flexible tension exerting means, said first flexible means having opposite ends connected to one of each of said members and extending from said ends in one axial direction, said second flexible means having opposite ends also connected to one of each of said members and extending from its opposite ends in the axial direction opposite said one axial direction, said members and flexible means completing a closed loop, and means for eliminating lost motion from said closed loop and for assuring movement of each member in the axially opposite direction from the other member upon axial movement of either member comprising guide means for supporting said flexible means in movable relationship in said closed loop.

11. In the combination according to claim 8, said member comprising an annular outer member coaxial with said passage and an inner member coaxial with said annular member for progressively restricting the opening of the latter upon said simultaneous movement toward said location, the outer periphery of said annular member being in sliding engagement with the wall of said passage to effect a high resistance to fluid flow therebetween.

12. In the combination according to claim 11, said inner member being movable in one axial direction upon said simultaneous movement toward said location, the inner surface of said annular member and the outer surface of said inner member diverging in said one axial direction.

13. In the combination according to claim 8, said throttle members comprising an outer annular member and a coaxial inner member defining said flow diffuser, means for supplying fuel to said passage throughout an intermediate range of said simultaneous movement from said predetermined location comprising a transfer slot opening into said passage adjacent said region of maximum restriction when said members are at said location, a transfer duct extending into said annular member for conducting fuel thereinto from said transfer slot, the sidewalls of said passage and annular member having cooperating valve portions for restricting communication between said transfer slot and transfer duct when said members are at said location, for progressively increasing said communication throughout limited opening movement of said members from said location, for effecting communication between said transfer duct and passage upstream of said annular member when said members are at said location, and for decreasing the latter communication upon said opening movement of said members from said location, and bypass duct means in said annular member for effecting communication between said transfer duct and passage downstream of said region of maximum restriction for said diffuser.

14. In the combination according to claim 13, said valve portions for effecting said communication between said transfer duct and passage upstream of said annular member also comprising means for restricting the latter communication when said members are at said location and for progressively increasing the latter communication upon said simultaneous movement for a limited extent from said location.

15. In the combination according to claim 8, said throttle members comprising an outer annular member and a coaxial inner member defining said flow diffuser, means for supplying fuel to said passage throughout an intermediate range of said simultaneous movement from said predetermined location comprising a transfer slot opening into said passage adjacent said region of maximum restriction when said members are at said location, a transfer duct extending through said annular member for conducting fuel from said transfer slot into said passage, the sidewalls of said passage and annular member having cooperating valve portions for decreasing the communication between said transfer slot and transfer duct upon said simultaneous movement of said members beyond a predetermined intermediate location 16. In the combination according to claim 15, the sidewalls of said annular member and inner member having cooperating valve portions for restricting communication between said transfer duct and passage when said members are at said location and for progressively increasing said communication as said members move from said location.

17. In the combination according to claim 15, the sidewalls of said passage and annular member having cooperating valve portions for restricting the communication between said transfer slot and transfer duct when said members are at the first named predetermined location and for progressively increasing the last named communication upon said simultaneous movement in the direction from said first named location toward said intermediate location.

18. In the combination according to claim 17, the sidewalls of said annular member and inner member having cooperating valve portions for restricting communication between said transfer duct and passage when said members are at said location and for progressively increasing said communications as said members move from said location.

* * * * *